United States Patent [19]

Reid, Jr. et al.

[11] 4,009,001

[45] Feb. 22, 1977

[54] PROCESS FOR THE PRODUCTION OF SPACE-DYED EFFECTS ON ACRYLIC YARNS

[75] Inventors: James P. Reid, Jr.; Bobby L. McConnell, both of Greensboro, N.C.

[73] Assignee: Burlington Industries, Inc., Greensboro, N.C.

[22] Filed: Sept. 23, 1975

[21] Appl. No.: 616,015

Related U.S. Application Data

[63] Continuation-in-part of Ser. No. 468,989, May 10, 1974, abandoned, which is a continuation of Ser. No. 247,385, April 25, 1972, abandoned.

[52] U.S. Cl. ..... 8/15; 8/14; 8/166; 8/175

[51] Int. Cl.[2] ..... D06P 5/12; D06P 5/22

[58] Field of Search ..... 8/14, 15, 166, 175

[56] References Cited

UNITED STATES PATENTS

| | | | |
|---|---|---|---|
| 2,336,341 | 12/1943 | Bock et al. | 8/15 |
| 3,222,118 | 12/1965 | Coleman | 8/115.5 |
| 3,869,250 | 3/1975 | Wegmüller et al. | 8/15 |
| 3,926,548 | 12/1975 | Moriyama et al. | 8/115.5 |

*Primary Examiner*—John Kight, III
*Attorney, Agent, or Firm*—Cushman, Darby & Cushman

[57] ABSTRACT

A process for producing space-dyed acrylic yarns is disclosed, wherein an acrylic yarn containing at least 50% by weight of basic-dyeable acrylic fibers has up to 80% the length thereof contacted with a resisting amount of an aqueous solution of a preferably divalent metal cation at a pH of about 2.5 to about 8.0. The yarn is then bulked by steaming to fix the ion on the fibers, and thereafter the yarn is dyed, with at least one basic dye, and the treated areas of the yarn resist the basic dye to produce a space-dyed appearance.

The products of the present process may be used in knit and woven goods and the like whenever a space-dyed appearance is desired.

15 Claims, No Drawings

PROCESS FOR THE PRODUCTION OF SPACE-DYED EFFECTS ON ACRYLIC YARNS

CROSS REFERENCE OF RELATED APPLICATIONS

This application is a continuation-in-part of application Ser. No. 468,989, filed May 10, 1974, which in turn is a continuation of Ser. No. 247,385, filed April 25, 1972. Both applications are now abandoned.

BACKGROUND OF THE INVENTION

The production of space-dyed yarns, i.e. yarns having two or more shades and/or colors on the same yarn end, is well known to the prior art. Various methods have been used by the art to produce the space-dyed effect. Wool has been treated with various chemical modifiers, such as chromates or bichromates, alkalis, and sulfonic acids or derivatives thereof, in order to impart to the treated wool different dyeing characteristics as compared to the untreated wool. See, e.g. U.S. Pat. Nos. 3,310,361, 3,352,624 and 3,481,682.

British Pat. No. 1,133,054 discloses a process for producing multicolored acrylic fiber textiles wherein each yarn end is of a single color and/or shade but the textile material itself is composed of yarns having differing colors and/or shades. The acrylonitrile textile fibers, containing acidic groups but free from basic groups, are dyed with a premetallized acid dyestuff in a bath which contains mono-or-divalent metal or ammonium salts, and then the thus dyed textile material is combined with an undyed acrylonitrile fiber containing acidic groups but free from basic groups. Thereafter, the resulting textile is dyed with a cationic or dispersed dyestuff which serves to dye the second textile material a different color from the first textile material. The mono-or-divalent metal or ammonium salt serves to increase the takeup, i.e. increases the distribution, of the premetallized dyestuff within the fiber of the first acrylonitrile textile material, thus producing particularly dark shades, and also serves to prevent staining of the first dyed acrylonitrile textile material with the second, or cationic, dyestuff during the second dyeing step.

U.S. Pat. No. 3,253,875 discloses space dyeing nylon textile material by covering selected areas thereof with a metal foil and thereafter subjecting the textile material to moist heat. The protective metal foil covering is then removed and the treated material is dyed by immersion in an anionic dye bath with the production of variable or multitoned dyeing, wherein the foil-protected areas of the nylon are less heavily hued than the exposed areas. U.S. Pat. No. 3,401,542 discloses the use of a moving roll having aligned recesses into which dye is intermittently fed by pneumatic means in order to produce novel dye effects on yarns passing therethrough. British Pat. No. 1,025,805 discloses the use of the roll wherein a single yarn or groups of yarn are intermittently deflected into a liquor supply device. U.S. Pat. No. 3,335,583 discloses a system of parallel rolls and a trough, with different colors fed at different areas along the trough and the yarn being fed obliquely to the trough in order to contact different colors. British Pat. No. 1,137,415 discloses a system wherein tensioned yarn is intermittently reciprocated transversely through a jet of dye liquor.

U.S. Pat. No. 3,120,422 discloses a process wherein reactive dye is injected into various locations of a wound yarn package, which is then allowed to stand until the dye reaction occurs. U.S. Pat. No. 3,242,875 discloses a system wherein stripes are printed on a knitted fabric which is then unraveled, and the unraveled yarn is then reknitted in order to produce a novel effect on the final knitted product.

SUMMARY OF THE INVENTION

A space-dyed effect is produced on acrylic yarn by forming resist areas on the acrylic yarn by contacting at least 5% but less than 80% of the length of the acrylic yarn, which contains more than 50 percent by weight of basic-dyeable acrylic fibers, with an aqueous solution of one or more selected polyvalent metal cations, preferably divalent and colorless. The solution should be at a pH of about 2.5 to about 8.0. The treated yarn is bulked by steaming at a temperature of about 170° to 240° F, and then the treated bulked yarn is dyed with at least one basic dye. The treated areas of the yarn resist the basic dye to produce a yarn having a space-dyed appearance.

DESCRIPTION OF THE INVENTION

The present invention relates to a process for space-dyeing basic-dyeable acrylic fibers. Briefly, the fibers are contacted, in selected areas, with a solution of a selected polyvalent metal cation, preferably divalent and colorless, at a pH of about 2.5 to about 8.0. Thereafter, the yarn is bulked by steaming, which serves to fix the ion on the fibers, and then the yarn is dyed with at least one basic dye. The areas of the yarn treated with the ion resist the basic dye, producing a space-dyed appearance in the final yarn product.

The basic-dyeable acrylic fibers may be any of the acrylic or modacrylic fibers which are dyeable with basic dyes. Such acrylic fibers include those sold under the trade names Orlon, Creslan, Dynel, and others, and designated as basic-dyeable. As known to the art, basic-dyeable fibers contain acidic groups located along the fiber, these serving as sites for reaction with cationic dyestuffs. The acrylic fiber may be a blend of basic-dyeable acrylic fibers and acid-dyeable acrylic fibers, provided, however, that more than half of such blended fibers are basic-dyeable. That is, the acrylic yarn may contain, in addition to the basic-dyeable acrylic fibers, from 0–49% by weight of acid-dyeable acrylic fibers. Preferably, the blended acrylic yarn contains no more than 30% by weight of acid-dyeable acrylic fibers.

The acrylic yarn which is contacted with the ion solution may be an undyed acrylic yarn or the yarn may previously have been dyed, and generally such previous dyeing is with a dye which produces a different color or shade from that of the dye subsequently used in the process of the present invention, as more fully explained hereinafter. Whether or not the acrylic yarn has previously been dyed generally depends upon the number of colors which are desired in the final space-dyed yarn product.

The basic-dyeable acrylic yarn is contacted with a solution of at least one polyvalent metal cation. The ion may be calcium, barium, magnesium, strontium, tin, zinc, lead, iron, nickel, cobalt, copper or manganese, or mixtures thereof. The divalent cations are preferred, and those which are colorless generally are the most effective. The acrylic yarn may be contacted with the ions by dipping selected portions of the yarn in an aqueous ion solution, by spraying the ion solution upon selected portions of the yarn, or by other methods known to the art, such as padding.

The ion solution is prepared by dissolving at least one salt of the aforementioned metals in water. The pH of the solution should be adjusted between 2.5 to about 8.0, preferably from 3.0 to 4.0. The pH may be adjusted by conventional methods. For instance, the adjustment of pH to a value of 4.0 or higher is preferably accomplished by the addition of weak acids, such as acetic acid or citric acid, whereas stronger acids, such as sulphuric acid, hydrochloric acid, phosphoric acid and the like, may be conveniently used to adjust the pH to lower values, i.e., below 4.0. The concentration of the salt in the aqueous solution is not critical, but will generally vary from about 0.1 to about 30g of salt per liter of solution. With salt concentrations of less than 0.1g per liter, it is difficult to obtain enough add-on of the ion onto the acrylic fiber within practical time limits, whereas at concentrations of 30g per liter and above, in most instances, difficulties in knitting will be encountered due to yarn harshness. Preferably, the salt concentration will vary from about 15 to about 25g/liter; more preferably the salt concentration will be about 25g/liter.

Preferably, the acrylic yarn is contacted with the cation solution at ambient conditions, although higher or lower temperatures and pressures can be used as desired. In some instances, it may be desirable to use elevated temperatures to increase the rate of add-on, but this has generally been found unnecessary. Generally, the yarn is contacted with an aqueous solution of the salt at a temperature of about 35° to about 200° F.

To obtain the desired space-dyed appearance of the final dyed yarn product, only a selected portion of the yarn will be contacted with the salt solution. Generally, from 5 to 80% of the yarn length will be contacted by the salt solution, preferably 25 to 40%. For the most desirable space-dyed appearance, it is most preferred that the average length of each area contacted by the salt solution be from about 3 inches to about 12 inches in length, with untreated areas of about 1 inch to about 40 inches in length in between each such area that has been treated by contact with the salt solution.

The add-on of the ion or ions from the salt solution onto the acrylic yarn will vary according to a number of factors, including the particular salt or salts involved, the concentrations thereof, the solution temperature, the time of immersion or other contact, the pH of the salt solution, etc. Generally, the effect of exposure time, that is, the time the yarn is contacted by the salt solution, is not particularly significant. For instance, tests with solutions of 25g/liter of calcium chloride on 100% basic-dyeable Creslan yarn indicated that no significant difference in final effect was obtained with exposure times ranging from 15 seconds to 5 minutes. Depending upon the particular salt involved, the exposure time can range from as little as 5 seconds up to 10 minutes or even more, i.e., an hour or two or even several days, but for commercial yarn production, it is clear that the shorter contact times are greatly preferred. Generally, the ion add-on will range from about 5 to about 100 mg of metal ion per gram of acrylic yarn, preferably about 30 to 40 mg/g.

The anions associated with the aforementioned metal cations of the invention are not critical, as long as a soluble salt is produced, and various organic and inorganic anions may be conveniently used. Mixed anions may be used. Of course, the anion which is selected should not adversely affect the acrylic yarn and should not adversely affect the dyeing thereof. Suitable anions include the chloride, acetate, chromate, and sulfate anions, although these are given by way of example and not by way of limitation.

After the acrylic yarn has been contacted by the salt solution, it is preferable, though optional, to remove excess salt solution from the yarn. This can be conveniently accomplished by blotting or squeezing the treated portion of the yarn, and it will be appreciated that care should be taken to prevent excess salt solution from contacting those areas of the yarn wherein a resisting effect is not wanted. The yarn is then bulked by steaming at a temperature of 175 to 240° F, preferably 205° – 220° F, for a time sufficient to fix the metal ions on the acrylic yarn. Generally, the yarn will be bulked for at least 30 minutes. The bulking time may be as long as 6 hours, or even more, but generally it is preferred that the bulking time be from 45 to 60 minutes.

After the metal ions have been fixed on the acrylic yarn by the bulking step, the yarn is dyed by contacting same with at least one basic dye. The areas of the yarn which have not been contacted by the salt solution are dyed, whereas the treated areas of the yarn resist the dye. Any basic dye may be used in this dyeing step, including azo dyes, anthraquinone dyes and phthalocyanine dyes. By way of example, the following commercial dyestuffs can be mentioned as suitable (Color Index Part I usage numbers are given in parentheses where known):

Calcozine Fuchsine RTN (Basic Violet 14)
Sevron Orange L (Basic Orange 24)
Sevron Rubine Y
Sevron Green B (Basic Green 3)
Sevron Blue B (Basic Blue 21)
Sevron Brill. Red 4G (Basic Red 14)
Sevron Orange G (Basic Orange 21)
duPont Basic Brown BR (Basic Brown 4)
duPont Victoria Green small crystals (Basic Green 4)
Sevron Yellow RL (Basic Yellow 11)
Sevron Brill. Red BN (Basic Red 49)
Sevron Yellow 2RL
Maxilon Blue GRLA (Basic Blue 41)
Maxilon Red BL (Basic Red 22)
Sevron Brown YL (Basic Orange 26)
Sevron Gold 67
Sevron Blue NF All of the above dyestuffs were found to be effectively resisted by basic-dyeable acrylic fibers treated with calcium chloride according to the process of the present invention, with the exception of some of the yellow, orange, and gold colors, in that the use of these colors resulted in yarns having little or no color or shade contrast. It is believed that these lighter-colored dyes, even when their dye-resist properties seemed to be marginal, actually were exhibiting the results of the dye-resist action of the invention. A number of the yellowish dyes are known to be fluorescent; and when these were used alone, i.e., without combination with other dyes as commonly practiced in the art, the fluorescence tended to mask the color contrast between cation-treated and untreated areas. Supporting this view of the actual effectiveness of the yellowish dyes is the fact that combination with minor amounts of other basic dyes quenched the fluorescence and brought out shade contrasts as marked as with the non-fluorescent dyes. It is nevertheless generally preferred, for maximum simplicity, that the basic dye be a non-fluorescent dye.

Certain of the dark shades of navy, green or brown dyestuffs produce colors so deep that when relatively high dyebath concentrations are used no clear difference is noted between the treated areas and the non-treated areas of the yarn. Thus, for these dark shades, an excessive depth of shade should be avoided if a clear contrast is desired. Generally, therefore, when using the dark shades, the dye pickup will be at most about 4% by weight of the fabric.

The basic dye or dyes may be mixed with one or more acid dyes, especially when blends of acid-dyeable and basic-dyeable acrylic fibers are used. Generally, the treated areas of the yarn will not resist the acid dye, but it has unexpectedly been found that stannous ion-treated areas will resist both acid dyestuffs and basic dyestuffs and that this effect can be achieved even with yarns containing a preponderance of acid-dyeable acrylic fibers. For instance, a yarn made of 75% acid-dyeable and 25% basic-dyeable acrylic fibers, when treated with $SnCl_2$ according to the process of this invention, will resist both acid dyes and basic dyes with no adverse effect on yarn quality, and sharp, clear resist areas are produced.

The dyeing conditions, such as dye solution temperature, dye pick-up, dyebath pH, the time the yarn is contacted by the dye and the like, are all conventional and can be varied to produce different effects, as well known to those in the art. For instance, the dye pick-up may be varied by conventional methods to achieve different degrees of depth of shade. A dyeing amount of the dye will be applied to the fiber, generally at least about 1% by weight but to 8% or even higher, e.g., 10%, by weight of dye, based on the weight of the yarn. The dyeing temperatures will preferably be about 180° to about 220° F.

The space-dyed acrylic yarns may be used where conventional acrylic yarns have been used, wherever a space-dyed appearance is desired, such as in sweaters, sox, and other apparel applications.

EXAMPLES OF THE INVENTION

EXAMPLE 1

A 10g skein of Type 61 Creslan basic-dyeable acrylic fiber was treated in six areas, six inches apart, with 2 ml per area of a 10g per liter solution of calcium chloride at a pH of 3.5. The treated skein was then bulked by steaming at 212° F for thirty minutes, washed with water to remove excess salt, and dyed by immersing for 30 minutes in an aqueous dye bath containing 2% by weight of Maxilon Red BL (Basic Red 22) and 2% by weight of Sevron Green B (Basic Green 3) at a pH of 5.2. The dyed yarn was dried and knit into a sleeve, which had a very pleasing appearance of very light brown areas on the dark brown background.

EXAMPLE 2

A 10g skein of 70% Type 61 basic-dyeable and 30% Type 94 acid-dyeable Creslan acrylic fiber was treated in six areas, 6 inches apart, with 2 ml per area of a 25g per liter solution of calcium chloride at a pH of 3.5. The treated skein was then bulked by steaming at 215° F for 30 minutes, washed to remove excess salt, and dyed by immersing for 30 minutes in a dye bath at 210° F containing 0.20% by weight of acetic acid, 0.25% by weight of Sevron Brown YL (Basic Orange 26) and 0.20% by weight of Brill. Sky Blue BLWA (Acid Blue 203). The dyed yarn was dried and knit into a sleeve which demonstrated a variegated effect of different colors including blue, orange, brown and tan.

EXAMPLE 3

This example indicated the effect of pH on the resist action. Skeins of Creslan Type 61 basic-dyeable acrylic fiber were treated with equal amounts of 25% calcium chloride solution at the pH conditions set forth in the table below (the pHs of the calcium chloride solutions were adjusted with acetic acid, for pHs of 4.0 to 8.1, and hydrochloric acid, for pHs of 2.0 to 3.5), bulked by steaming at 240° F for 30 minutes, and dyed at a pH of 4.5 by immersion for 30 minutes in a dyebath containing 2% by weight of Sevron Blue B (Basic Blue 21).

| pH of Solution | Resist |
|---|---|
| 8.1 | Very little resist |
| 7.0 | Moderate resist |
| 6.0 | Moderate resist |
| 5.1 | Good resist |
| 4.0 | Good resist |
| 3.5 | Excellent resist |
| 3.0 | Excellent resist-poor knitting |
| 2.0 | Excellent resist-poor knitting |

It will be appreciated from the above table that pH has a substantial effect on the dye-resist character of the treated acrylic. At pH of 8 and greater, very little resist effect was noted, whereas at pH of 3.0 or less, difficulties in knitting, believed to result from increased yarn harshness, were encountered.

EXAMPLE 4

A skein of yarn containing 75% acid-dyeable Type 44 and 25% basic-dyeable Type 42 Orlon acrylic fiber weighing 1200 grams was treated in areas six inches long with 50 ml of a 25g per liter solution of stannous chloride. After the stannous chloride treatment, the skein was bulked for 1 hour by steaming at 210° F, dried, knit into a sleeve, and then dyed by immersion for 30 minutes in a dyebath containing 2% Isolan Orange R and 2% by weight of Sevron Blue NF. Both of the dyes, one acid and one basic, were resisted by the $SnCl_2$ treated area, with sharp clear resists. No adverse effect on the yarn quality was noted.

The above example was repeated, using, in the same proportions as before, the following replacements for stannous chloride: calcium chloride, magnesium chloride, cupric sulfate, manganous sulfate, zinc chloride, aluminum acetate, sodium chromate, calcium chloride-magnesium chloride (1:1), and calcium chloride-magnesium chloride-stannous chloride (1:1:1). In every case, neither the acid dye nor the basic dye was resisted by the acrylic yarn, and the quality of the yarn was, in most instances, adversely affected. This indicated that the acrylic textile material generally does not exhibit the resist effect unless the textile material contains sufficient basic-dyeable acrylic fibers when in combination with acid-dyeable acrylic fibers. Stannous chloride seems to be an exception to the general rule.

EXAMPLE 5

30 – 40 lbs. of Type 42 Orlon yarn in the form of 90 inch circumference skeins were treated in three areas, 30 inches apart, and six areas, fifteen inches apart, by dipping the skein into a 25g per liter solution of calcium chloride at a pH of 3.5–4, squeezing to remove excess solution, and thereafter bulking by steaming one portion for one hour at 210° F, and another for 45 minutes at 180° F. The treated yarns were dyed by immersion for 45 minutes in a solution containing 2% by weight of Sevron Blue NF at the pH of 5.0 and a temperature of 210° F. The 210° F bulked yarn skeins had sharp, clean resist patterns whereas the 185° F bulked yarn skeins had dull, muted resist patterns. It is evident that the space-dyed appearance of the yarn may be varied by selection of the bulking temperature.

EXAMPLE 6

Example 5 was repeated, with calcium acetate instead of calcium chloride, and with only the 210° F bulking temperature. Knitting behavior was improved. It was surmised that chloride causes corrosion of the knitting needles and resulting higher friction during knitting.

EXAMPLE 7

30–42 lbs of Type 42 Orlon yarn were treated as in Example 6. The treated yarn was knit into socks and dyed using the dyeing procedures of Example 6, except that the dye bath contained 0.02% by weight of Sevron Blue B and 1% by weight of Sevron Yellow RL. The resulting socks had a pleasing space-dyed appearance.

EXAMPLE 8

A 10g skein of Type 42 Orlon yarn was treated in four areas, six inches apart, by dipping into a solution of nickelous sulfate (20g/liter, pH 5) and squeezing off the excess liquid. The skein was then bulked at 212° F in steam for 30 minutes and dyed as in Example 1. The dyed yarn was dried and knit into a sleeve having an aesthetically pleasing combination of light and dark areas.

EXAMPLE 9

Test skeins of 10g of Type 61 Creslan were partially dipped into solutions of the following metal halides, at the concentrations indicated, for 1 minute. The skeins were then steamed for 20 minutes, washed, and dyed in a solution of 2% Sevron Blue for 30 minutes at 210° F. The salts used were:

ferric chloride hexahydrate 0.5g/liter
ferrous chloride tetrahydrate 0.5g/liter
lead dichloride 1g/liter
magnesium chloride 0.5g/liter
calcium chloride 0.5g/liter The lead, magnesium, and the two iron salts all produced distinctly contrasting dye shades on the treated and untreated areas of their yarns, though none so sharply defined as the calcium salt. The latter produced virtual whiteness in the treated areas, while the others permitted slight staining to occur.

It will be appreciated from the above that the yarns of the present invention are preferably bulked in the skein form — that is, in the substantially relaxed state. Preferably the yarns are in the completely relaxed state, with no tension exerted thereon during the bulking operation.

It will also be appreciated from the above that the yarns which are bulked will comprise a plurality of different types of yarn, some being shrinkable upon the application of heat and some being relatively resistant to the application of heat. In any event, at least two of the fibers from which the yarns are composed should have significantly different shrinkages upon being subjected to the bulking step. Preferably, at least 20% of each type of filament (that is, at least 20% of a filament have a high shrink characteristic and at least 20% of a filament having a low (or no) shrink characteristic) will be present in the yarn. Such yarns are conventional, and well-known in the art, and are, e.g., described in U.S. Pat. No. 2,810,281 and in Bulked Yarns: Production, Processing, and Applications, by Bohumil Piller, translated by Olga Steinerova, published by SNTL, Prague, in coedition with the Textile Trade Press, Manchester, England, 1973, pp. 156–210, the disclosures of which are hereby incorporated herein by reference.

What is claimed is:

1. A process for producing a space-dyed effect on an acrylic textile material, said process consisting essentially of contacting at least 5% but less than 80% of the length of an acrylic yarn comprising more than 50% by weight of basic-dyeable acrylic fibers with a resisting amount of an aqueous solution of a polyvalent metal cation selected from the group consisting of calcium, barium, magnesium, strontium, tin, zinc, lead, iron, nickel, cobalt, copper, and manganese ions and mixtures thereof at a pH of about 2.5 to about 8.0, thereafter bulking the yarn in the relaxed state by steaming at a temperature of about 170° to about 240° F., to fix the metal cation on the yarn and, thereafter dyeing said yarn with at least one basic dye, whereby the areas of said yarn treated with said cation resist said dye to produce a space-dyed appearance of said yarn.

2. Process according to claim 1 wherein said cation is divalent.

3. Process according to claim 2 wherein said cation is a calcium ion.

4. Process according to claim 3 wherein the solution of said calcium ion is an aqueous solution of calcium acetate.

5. Process as claimed in claim 4, wherein the concentration of said calcium acetate is about 25g/liter.

6. Process according to claim 2 wherein said solution is an aqueous solution of a soluble salt of said divalent cation.

7. Process according to claim 6, wherein the concentration of said salt is from about 0.1 to about 30g/liter.

8. Process according to claim 2, wherein said acrylic yarn is a dyed acrylic yarn, dyed with at least one dye which differs in color and/or shade from said basic dye.

9. Process according to claim 2, wherein said acrylic yarn consists essentially of basic-dyeable acrylic fibers.

10. Process according to claim 2, wherein said acrylic yarn is a blended acrylic yarn, containing said basic-dyeable acrylic fibers and up to 49% by weight of acid-dyeable acrylic fibers.

11. Process according to claim 10, wherein said blended acrylic yarn contains no more than 30% by weight of acid-dyeable acrylic fibers.

12. Process according to claim 2, wherein selected areas of said acrylic yarn are dipped in said solution.

13. Process according to claim 2, wherein selected areas of said yarn are sprayed with said solution.

14. Process according to claim 2, wherein said treated areas have an average length of from 3 inches to 12 inches.

15. Process according to claim 2, wherein the pH of said solution is from 3.0 to 4.0.

* * * * *